United States Patent [19]

Strate et al.

[11] 4,359,089

[45] Nov. 16, 1982

[54] CARRIER FOR BLOWOUT PREVENTER

[76] Inventors: Ronald A. Strate; Russell V. Bills, both of 1001, 500 4th Ave. SW., Calgary, Alberta T2P 2V6; James W. M. Anderson, R.R. #1, Mundare, Alberta, T0B 3H0, all of Canada

[21] Appl. No.: 220,317

[22] Filed: Dec. 29, 1980

[51] Int. Cl.[3] ..... E21B 33/06; E21B 41/00

[52] U.S. Cl. ..... 166/79; 166/383

[58] Field of Search ..... 166/75 R, 79, 381, 383; 414/688, 639, 640, 728, 742, 560

[56] References Cited

U.S. PATENT DOCUMENTS

| | | | |
|---|---|---|---|
| 2,527,255 | 10/1950 | Hunt | 175/52 |
| 2,615,681 | 3/1950 | True | 166/79 |
| 2,872,052 | 2/1959 | Ferguson et al. | 414/560 |
| 2,968,411 | 1/1961 | Jegge | 414/640 |
| 3,158,213 | 8/1960 | O'Neill et al. | 175/52 |
| 3,268,093 | 8/1966 | Keiter | 414/560 |
| 3,498,375 | 3/1970 | McEwen et al. | 166/79 |

*Primary Examiner*—Stephen J. Novosad
*Assistant Examiner*—Joseph Falk
*Attorney, Agent, or Firm*—Harold H. Dutton, Jr.; George H. Dunsmuir

[57] ABSTRACT

A carrier/handler for an oilwell blowout preventer includes a skid defined by a pair of sides with crossbars extending therebetween, a carriage slidably mounted on rollers on the skid for movement toward and away from a wellhead, a cradle pivotally mounted on the carriage for carrying a blowout preventer in the horizontal position, and for movement from such horizontal position to the vertical position, and hydraulic cylinders for moving the carriage along the skid, for moving the carriage transversely to align the blowout preventer with the wellhead, for moving the cradle from the horizontal to the erect position, and for moving the blowout preventer and a slide portion of the cradle vertically into and out of engagement with a well casing.

6 Claims, 2 Drawing Figures

CARRIER FOR BLOWOUT PREVENTER

BACKGROUND OF THE INVENTION

This invention relates to a carrier for oilwell equipment, and in particular to a carrier for an oilwell blowout preventer.

In the course of drilling oilwells, it is often necessary to mount a blowout preventer over the hole at ground level. The blowout preventer is a stack of hardware, including a top or annular preventer, a plurality of rams separated by adapter spools and a casing bowl for mounting the blowout preventer on the top end of the well casing. The blowout preventer is an unwieldly piece of equipment, standing approximately 20 feet high and weighing approximately 26 short tons. In the past, mounting and removal of the preventer was a cumbersome procedure, requiring the use of a low-boy and derricks or the like.

Obviously, there exists a need for a blowout preventer carrier/handler which solves the problems mentioned above. Apparatuses for handling heavy articles are disclosed, for example, by U.S. Pat. Nos. 2,872,052, which issued to L. G. Ferguson et al. on Feb. 3, 1959; 3,212,593, which issued to K. E. Reischl on Oct. 19, 1965; 3,268,093, which issued to R. W. Keiter on Aug. 23, 1966; 3,299,957, which issued to J. V. O'Neill et al. on Jan. 24, 1967; and 3,498,375, which issued to J. D. McEwen et al. on Mar. 3, 1970. However, none of the apparatuses described in these patents is suitable for handling equipment of the type described hereinbefore. The Reischl et al, Keiter and McEwen et al patents are of greatest interest, because they disclose the use of fluid actuated or hydraulic cylinders for raising and lowering various articles. The McEwen et al patent even discloses a dolly, which carries a blowout preventer in the vertical position, the dolly being movably mounted on an oilwell derrick substructure. However, as mentioned in the McEwen et al patent, the blowout preventer must be lifted from the dolly and moved into position by a travelling block.

It is readily apparent that a need exists for a carrier for a blowout preventer which carries the blowout preventer on site, without requiring the use of derricks or the like, either for loading or unloading the preventer, or for placing the preventer in position.

The object of the present invention is to provide a relatively simple apparatus for handling oilwell equipment, and in particular a carrier for carrying, mounting and demounting blowout preventers.

SUMMARY OF THE INVENTION

Accordingly, the present invention relates to a carrier for a blowout preventer or the like comprising frame means, skid means on said frame means permitting sliding of said frame means into and out of close proximity to a well; carriage means movably mounted on said frame means for movement toward and away from said well when said frame means is in close proximity to a well; first drive means for moving said carriage means along said frame means; cradle means pivotally mounted on said carriage means for carrying a blowout preventer in the horizontal position; second drive means for rotating said cradle means with respect to said carriage means to move the blowout preventer between the horizontal and vertical positions; slide means for carrying the blowout preventer on the cradle; and third drive means for moving said slide means relative to said cradle means, whereby the blowout preventer can be moved vertically into and out of well engaging position.

BRIEF DESCRIPTION OF THE DRAWINGS

The invention will now be described in greater detail with reference to the accompanying drawings, which illustrate a preferred embodiment of the invention, and wherein.

DESCRIPTION OF THE PREFERRED EMBODIMENTS

Figure 2:
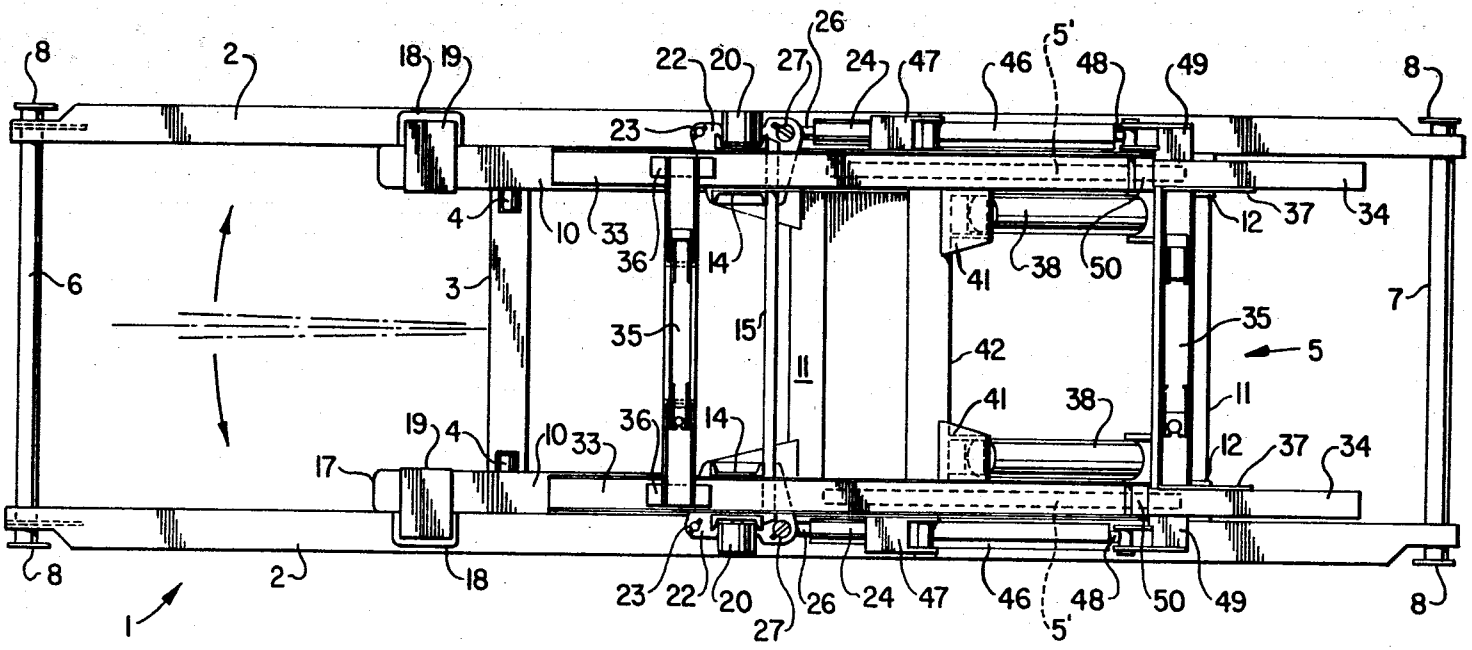
FIG. 2 is a plan view of the carrier of FIG. 1.

With reference to the drawings, the carrier of the present invention includes a skid in the form of a frame generally indicated at 1 which is defined by a pair of elongated T-beam type sides 2. The sides 2 act as skids for sliding the frame 1 and consequently the entire carrier along the ground toward and away from a well casing (not shown). A plurality of crossbars 3 extend between and interconnect the sides 2 of the frame 1. Rollers 4 are provided in the crossbars 3 for slidably supporting a carriage generally indicated at 5. The carriage 5 is also supported by tubes 5' (FIG. 2) extending between two of the crossbars 3 near the ends thereof. The front and rear ends of the sides 2 are interconnected by rods 6 and 7, respectively, which have end caps 8. The front rod 6 can be removed through slots 9 (one shown) in the leading or front end of the sides 2. The rod 6 is removed so that the frame 1 can be slid into position around the top of a well, i.e., with the front ends of the sides 2 on either side of the top of the well casing.

Figure 1:
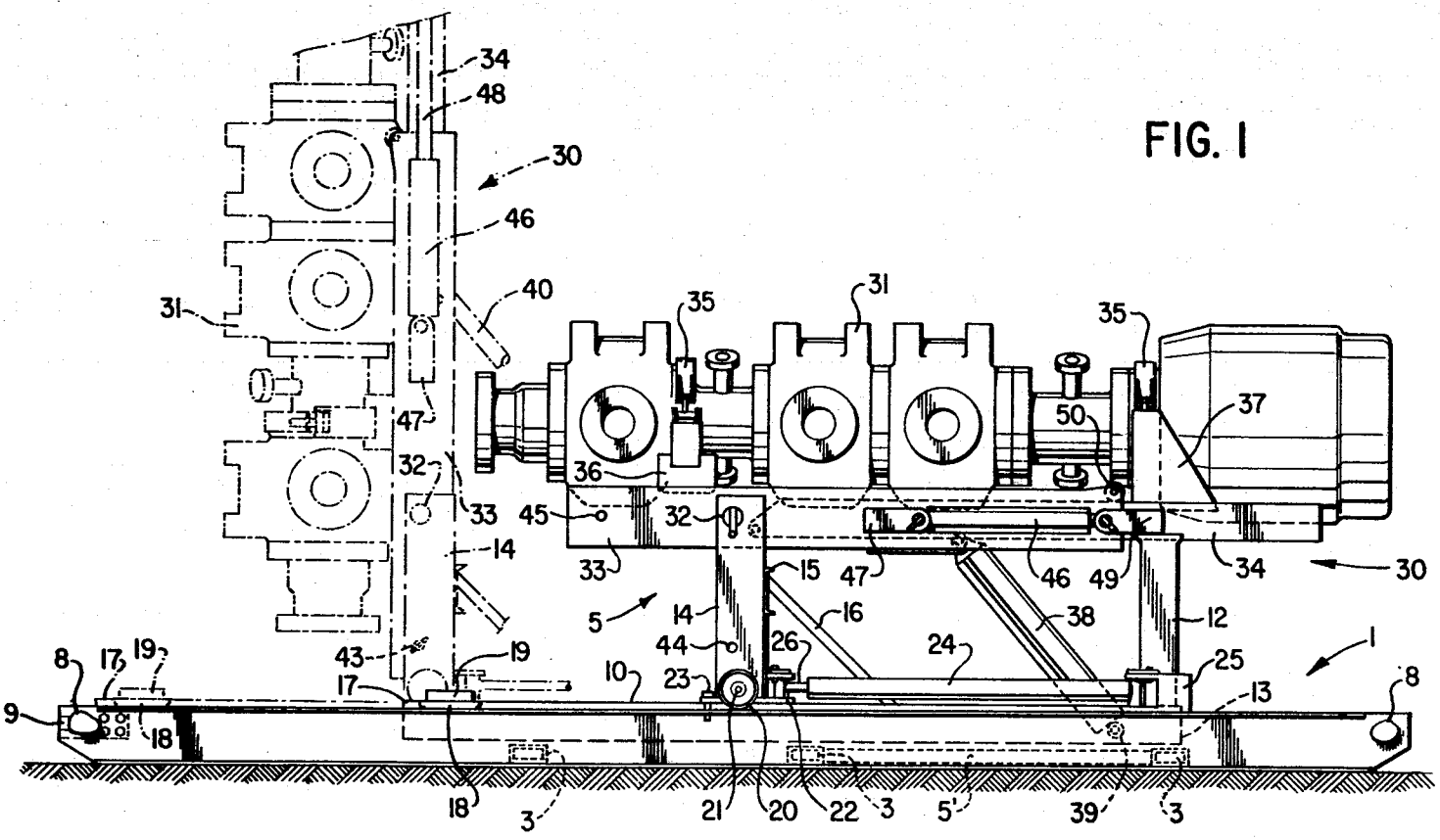
FIG. 1 is an elevation veiw of a carrier for a blowout preventer in accordance with the present invention, with a blowout preventer mounted thereon.

The carriage 5 includes a base defined by sides 10 slidably mounted on the rollers 4, with crossbars 11 extending between such sides 10. A pair of vertical posts 12 extend upwardly from rear ends 13 of the sides 10. A second pair of posts 14 extend upwardly from the sides 10 slightly in front of the middle thereof. A crossbar 15 extends between the posts 14 above the bottom thereof, and inclined braces 16 (one shown) extend upwardly from one of the crossbars 11 to reinforce the posts 14. The front end 17 of the carriage 5 is supported and guided on the rails defined by the sides 2 of the frame 1 by slides 18 on arms 19 extending outwardly from the top front end of each side 10 of the carriage base. A pair of rollers 20 are mounted on stub axles 21 on the bottom ends of posts 14 for slidably supporting the middle of the carriage 5 on the frame 1. A bracket 22 at the bottom end of each post 14 includes a hole (not shown) for receiving a pin 23. The pin 23 passes through a hole (not shown) in the side 2 of the frame 1 for locking the carriage 5 in one position during movement of the frame 1. One end of each of a pair of hydraulic cylinders 24 is pivotally mounted on a bracket 25 on one side 2 of the frame 1. A piston rod 26 extends forwardly from each cylinder 24 and the leading end thereof is pivotally connected to the bracket 22 by a pin 27. Actuation of the cylinders 24 results in movement of the carriage 5 along the frame 1, between the retracted positions of the carriage shown in solid lines in FIG. 1, and the extended or forward position, shown in phantom outline in FIG. 1. Moreover, selective actuation of either cylinder 24 provides for steering, i.e., a degree of lateral displacement is possible to enable accurate location of the blowout preventer with respect to the wellhead.

A cradle generally indicated at 30 for supporting a blowout preventer 31 is pivotally mounted on the top ends of the posts 14 for rotation around pins 32 (one shown) in the posts 14. The cradle 30 includes a main, stationary frame defined by sides 33, and a movable frame defined by sides 34, which are slidably mounted in the sides 33. The movable frame is supported by the posts 12. The main frame supports the bottom end of the blowout preventer 31 and the movable frame supports the top end thereof. The blowout preventer 31 is retained on the cradle 30 by straps 35. The front straps 35 extend between supports 36, which are slidably mounted on the sides 33 of the main cradle frame. The rear straps 35 extend between generally triangular side supports 37 for the blowout preventer.

The cradle 30 is rotated around the pins 32 from the horizontal rest position (shown in solid lines in FIG. 1) to the vertical position by a pair of hydraulic cylinders 38, which are pivotally mounted on the base of the carriage 5 by means of pins 39. The top, outer ends of piston rod 40 of each cylinder 38 is pivotally connected to brackets 41 on a crossbar 42 extending between the sides 33 of the main cradle frame. Once in the vertical position, the cradle 30 is maintained there by pins 43 (one shown) which are inserted in aligned holes 44 and 45 in the post 14 and main cradle frame, respectively. The movable cradle frame is slid relative to the main cradle frame by means of hydraulic cylinders 46 pivotally mounted in brackets 47 on the sides 33 of the main cradle frame. Piston rods 48 extend outwardly from the cylinders 46, and the outer free ends of such rods are pivotally connected to brackets 49 on the sides 34 of the movable cradle frame. When the cylinders 46 are actuated, the movable cradle frame, and consequently the support 36 and the blowout preventer 31 are moved longitudinally relative to the main cradle frame. The sides 34 of the movable cradle frame are maintained in the main cradle frame by rollers 50 on one end of each side 33 of the main cradle frame.

In operation, the frame 2 is slid into position close to a wellhead (not shown). Usually, the rod 6 is removed so that the frame 1 can be skidded into position with the sides 2 on each side of a wellhead. As mentioned hereinbefore, by extending one piston rod 26 while retracting the other, the carriage 5 can be caused to twist or move laterally with respect to the frame 1.

Thus, the longitudinal axis of the blowout preventer 31 can be moved into alignment with the wellhead (not shown). With the frame 1 in position, the hydraulic cylinders 46 are actuated to extend the piston rods 48 which slide the movable frame of the cradle 30 away from the main frame. Alternatively, the movable frame of the cradle 30 can be moved away from the main frame before the frame 2 is slid into position. The cylinders 38 are actuated to raise the cradle 30 and the blowout preventer 31 to the vertical position shown in phantom outline in FIG. 1. When the blowout preventer is aligned with the top of the well casing (if necessary, by rotating the cradle 30 as described hereinbefore), the hydraulic cylinders 46 are again actuated to move the blowout preventer down into the use position on top of a well casing. During the drilling of the well, the cradle may remain attached to the blowout preventer, and braced by the substructure of the drilling rig. Cylinders 38 are used to raise and lower the stack as needed during such operations as setting intermediate casing hanger slips, and cutting excess casing.

Thus, there has been described a relatively simple carrier for a blowout preventer which facilitates manipulation of the preventer.

Further modifications and alternative embodiments of the invention will be apparent to those skilled in the art in view of the foregoing description. Accordingly, this description is to be construed as illustrative only and is for the purpose of teaching those skilled in the art, the manner of carrying out the invention. It is further understood that the form of the invention herewith shown and described is to be taken as the presently preferred embodiment. Various changes may be made in the shape, size and general arrangement of components, for example, equivalent elements may be substituted for those illustrated and described herein, parts may be used independently of the use of other features, all as will be apparent to one skilled in the art after having the benefits of the description of the invention.

What is claimed is:

1. A carrier for a blowout preventer comprising frame means including skid means permitting sliding of said frame means into and out of close proximity to a well; roller means; carriage means movably mounted on said roller means for movement of said carriage means toward and away from said well when said frame means is in close proximity to the well; first drive means for moving said carriage means along said frame means; cradle means pivotally mounted on said carriage means for carrying a blowout preventer in the horizontal position; second drive means for rotating said cradle means with respect to said carriage means to move the blowout preventer between the horizontal and vertical positions; slide means for carrying the blowout preventer on the cradle means; and third drive means for moving said slide means relative to said cradle means, whereby the blowout preventer can be moved vertically into and out of well engaging position.

2. A carrier, according to claim 1, wherein said skid means includes a pair of elongated spaced apart skids, crossbars interconnecting said skids, and said roller means being mounted in said crossbars for slidably supporting said carriage means.

3. A carrier, according to claim 2, wherein said first drive means includes at least one hydraulic cylinder connected to said frame means, and a piston rod extending from said cylinder and connected to said carriage means.

4. A carrier, according to claim 1, wherein said first drive means includes a pair of hydraulic cylinders connected to said frame means, and piston rods extending from said cylinders and connected to sides of said carriage means, whereby movement of said piston rods in opposite directions causes twisting of the carriage means with respect to the longitudinal axis of said frame means.

5. A carrier, according to claims 1, 2, or 3, wherein said second drive means includes at least one hydraulic cylinder pivotally connected to said carriage means, and a piston rod extending from said cylinder and connected to said cradle means.

6. A carrier, according to claims 1, 2, or 3, wherein said third drive means includes a pair of hydraulic cylinders connected to said cradle means, and piston rods extending from said cylinders and connected to the sides of said slide means.

* * * * *